US008876131B1

(12) United States Patent
Gomes

(10) Patent No.: US 8,876,131 B1
(45) Date of Patent: Nov. 4, 2014

(54) EXERCISING SKATEBOARD

(71) Applicant: Joseph Gomes, Winthrop, MA (US)

(72) Inventor: Joseph Gomes, Winthrop, MA (US)

( * ) Notice: Subject to any disclaimer, the term of this patent is extended or adjusted under 35 U.S.C. 154(b) by 0 days.

(21) Appl. No.: 13/888,497

(22) Filed: May 7, 2013

(51) Int. Cl.
*B60M 1/00* (2006.01)
*B62B 3/02* (2006.01)

(52) U.S. Cl.
CPC ..... *B62B 3/02* (2013.01)
USPC ..... 280/87.021; 280/87.042

(58) Field of Classification Search
CPC ..... B62M 1/00; B62M 1/24; B62M 1/36
USPC ..... 280/87.021, 87.042, 89.11, 272
See application file for complete search history.

(56) References Cited

U.S. PATENT DOCUMENTS

| | | | | |
|---|---|---|---|---|
| 3,589,720 | A | 6/1971 | Agamian | |
| 4,076,267 | A | 2/1978 | Lipscomb | |
| 4,627,610 | A * | 12/1986 | Ishida et al. | 482/73 |
| 4,815,732 | A * | 3/1989 | Mahvi | 482/142 |
| 5,447,483 | A | 9/1995 | Liang | |
| D398,124 | S | 9/1998 | Schultz | |
| 5,921,901 | A | 7/1999 | Palacios | |
| 6,368,254 | B1 * | 4/2002 | Wall | 482/71 |
| 6,834,734 | B2 * | 12/2004 | Wu | 280/87.042 |
| 7,726,668 | B2 | 6/2010 | Sieb | |
| 7,780,585 | B1 * | 8/2010 | Rivas | 482/140 |
| 7,794,375 | B1 | 9/2010 | Jackson, Jr. | |
| 7,967,738 | B2 * | 6/2011 | Dauterive | 482/145 |
| 8,137,251 | B2 * | 3/2012 | Tozzi | 482/141 |
| D660,383 | S * | 5/2012 | Watterson et al. | D21/689 |
| 2003/0205881 | A1 * | 11/2003 | Shapiro et al. | 280/200 |
| 2010/0096823 | A1 | 4/2010 | Stillinger | |

* cited by examiner

*Primary Examiner* — Hau Phan
(74) *Attorney, Agent, or Firm* — Kyle A. Fletcher, Esq.

(57) ABSTRACT

The exercising skateboard is a wheeled apparatus capable of use in connection with a plurality of exercises involving kneeling, standing, or sitting. The skateboard is mounted atop of a plurality of caster wheels, which may be capable of rotational movement. A detachable seat back may be secured at different locations along a top surface of the exercising skateboard, and used in conjunction with riding the skateboard. The exercising skateboard further includes a pair of knee pads adjacent foot straps such that the exercising skateboard can be ridden in a standing or kneeling position. The foot straps may be further used in conjunction with the performance of sit-ups by an end user. A pair of attachable handles each extends upwardly from a pivot point, and provide handles for use in conjunction with propelling or riding of the exercising skateboard.

13 Claims, 7 Drawing Sheets

EXERCISING SKATEBOARD

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of exercising equipment, more specifically, a skateboard that is a piece of exercising equipment capable of performing a plurality of exercises thereon.

B. Discussion of the Prior Art

As will be discussed immediately below, no prior art discloses a skateboard that can be used in a plurality of configurations for performing a plurality of exercises; wherein the skateboard is mounted atop of a plurality of caster wheels such that the device is capable of rotational as well as linear movement; wherein the skateboard includes a seat back that attaches to a rear, top surface of the skateboard and provides a surface with which the end user can lean against when either fully or partially seated on said skateboard; wherein the skateboard includes a pair of foot straps as well as adjacent kneeling surfaces such that the end user may stand or kneel with at least one leg with respect to the skateboard while propelling the skateboard with the corresponding leg; wherein a pair of attachable handles extends upwardly and can rotate with respect to the skateboard in order to provide handles in connection with riding the skateboard; wherein the handles may include a tensioning knob that can lock the handles or limit the ease with which to rotate said handles; wherein lateral handles attached to spring-loaded webbing extend and retract form opposing sides of the skateboard; wherein an ab wheel and ab handles are also provided on the skateboard, and are able to slide back and forth with respect to the skateboard.

The Jackson, Jr. et al. Patent (U.S. Pat. No. 7,794,375) discloses an exercise apparatus for strengthening hamstring muscles. However, the apparatus does not enable sit ups to be performed in association with a skateboard, scooter, or kneeling device to conduct different styles of exercises therewith.

The Palacios Patent (U.S. Pat. No. 5,921,901) discloses a universal abdominal muscle exercise apparatus. However, the apparatus is not a wheeled apparatus that is propelled by an end user in connection with different types of exercises.

The Liang Patent (U.S. Pat. No. 5,447,483) discloses a crawling exerciser. However, the exerciser is not a skateboard that is adaptable for use in performing a plurality of different types of exercises.

The Agamian Patent (U.S. Pat. No. 3,589,720) discloses an exercise platform with movable hand and foot platforms. However, the movable platform is not a wheeled cart or skateboard that is used to perform different exercises.

The Stillinger et al. Patent Application Publication (U.S. Pub. No. 2010/0096823) discloses knee board for riding in a kneeling position on a ground surface and to methods of riding the same. However, the knee board does not resemble a skateboard that is adapted to provide different exercise or riding characteristics.

The Lipscomb Patent (U.S. Pat. No. 4,076,267) discloses an articulated skateboard that can be used with the rider in prone or kneeling positions. Again, the skateboard is not adapted to use in the multitude of riding orientations and/or exercises in conjunction there with.

While the above-described devices fulfill their respective and particular objects and requirements, they do not describe a skateboard that can be used in a plurality of configurations for performing a plurality of exercises; wherein the skateboard is mounted atop of a plurality of caster wheels such that the device is capable of rotational as well as linear movement; wherein the skateboard includes a seat back that attaches to a rear, top surface of the skateboard and provides a surface with which the end user can lean against when either fully or partially seated on said skateboard; wherein the skateboard includes a pair of foot straps as well as adjacent kneeling surfaces such that the end user may stand or kneel with at least one leg with respect to the skateboard while propelling the skateboard with the corresponding leg; wherein a pair of attachable handles extends upwardly and can rotate with respect to the skateboard in order to provide handles in connection with riding the skateboard; wherein the handles may include a tensioning knob that can lock the handles or limit the ease with which to rotate said handles; wherein lateral handles attached to spring-loaded webbing extend and retract form opposing sides of the skateboard; wherein an ab wheel and ab handles are also provided on the skateboard, and are able to slide back and forth with respect to the skateboard. In this regard, the exercising skateboard departs from the conventional concepts and designs of the prior art.

SUMMARY OF THE INVENTION

The exercising skateboard is a wheeled apparatus capable of use in connection with a plurality of exercises involving kneeling, standing, or sitting. The skateboard is mounted atop of a plurality of caster wheels, which may be capable of rotational movement. A detachable seat back may be secured at to a rear, top surface of the exercising skateboard, and used in conjunction with riding the skateboard. The exercising skateboard further includes a pair of knee pads adjacent foot straps such that the exercising skateboard can be ridden in a standing or kneeling position. The foot straps may be further used in conjunction with the performance of sit-ups by an end user. A pair of attachable handles each extends upwardly from a pivot point, and provide handles for use in conjunction with propelling or riding of the exercising skateboard. A pair of attachable handles extends upwardly and can rotate with respect to the skateboard in order to provide handles in connection with riding the skateboard. The handles may include a tensioning knob that can lock the handles or limit the ease with which to rotate said handles. The lateral handles attach to spring-loaded webbing that extends and retracts from opposing sides of the skateboard; wherein an ab wheel and ab handles are also provided on the skateboard, and are able to slide back and forth with respect to the skateboard.

An object of the invention is to provide a skateboard that may be used in a traditional sense as a skateboard, but may be further used as a knee board, or a skateboard that is ridden upon, or used in conjunction with the performance of sit-ups.

A further object of the invention is to provide a skateboard that includes a detachable backrest that when attached provides a surface with which to rest a back of an end user against.

A further object of the invention is to provide a pair of rotatable engaged handles that extend upwardly from the skateboard in order to provide a handle for the end user to grab when used in conjunction with a knee board or when riding the skateboard while sitting thereon.

An even further object of the invention is to provide each of the handles with a tensioning knob that adjusts the tension when rotating the handle or to lock the handle at a particular orientation with respect to the skateboard.

A further object of the invention is to provide a plurality of wheels that may be caster wheels or wheels able to rotate 360 degrees with respect to the skateboard in order to turn the skateboard.

A further object of the invention is to provide a pair of knee pads that are adjacent foot straps, which enables the skateboard to be used in a kneeling or standing orientation.

These together with additional objects, features and advantages of the exercising skateboard will be readily apparent to those of ordinary skill in the art upon reading the following detailed description of presently preferred, but nonetheless illustrative, embodiments of the exercising skateboard when taken in conjunction with the accompanying drawings.

In this respect, before explaining the current embodiments of the exercising skateboard in detail, it is to be understood that the exercising skateboard is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the exercising skateboard.

It is therefore important that the claims be regarded as including such equivalent construction insofar as they do not depart from the spirit and scope of the exercising skateboard. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
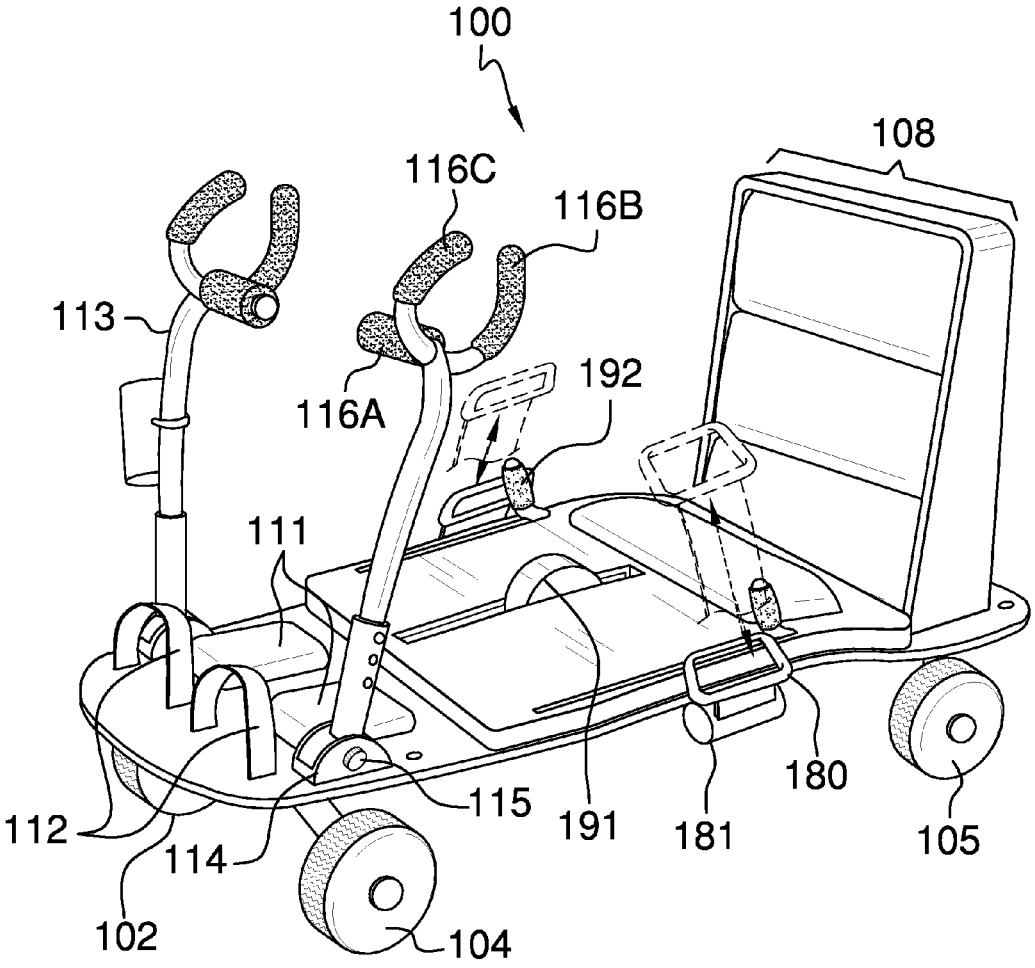
FIG. 1 illustrates a perspective view of the exercising skateboard by itself.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-8. An exercising skateboard 100 (hereinafter invention) includes a skateboard deck 101 from which wheels 102 attach to a bottom surface 103. The wheels 102 may be rotatable 104 or non-rotatable 105 such that the invention 100 is able to move linearly, and also turn. The skateboard deck 101 is a thin piece of construction and has a flat tail end 101A and a nose end 101B distally opposite of the tail end 101A.

Figure 7:
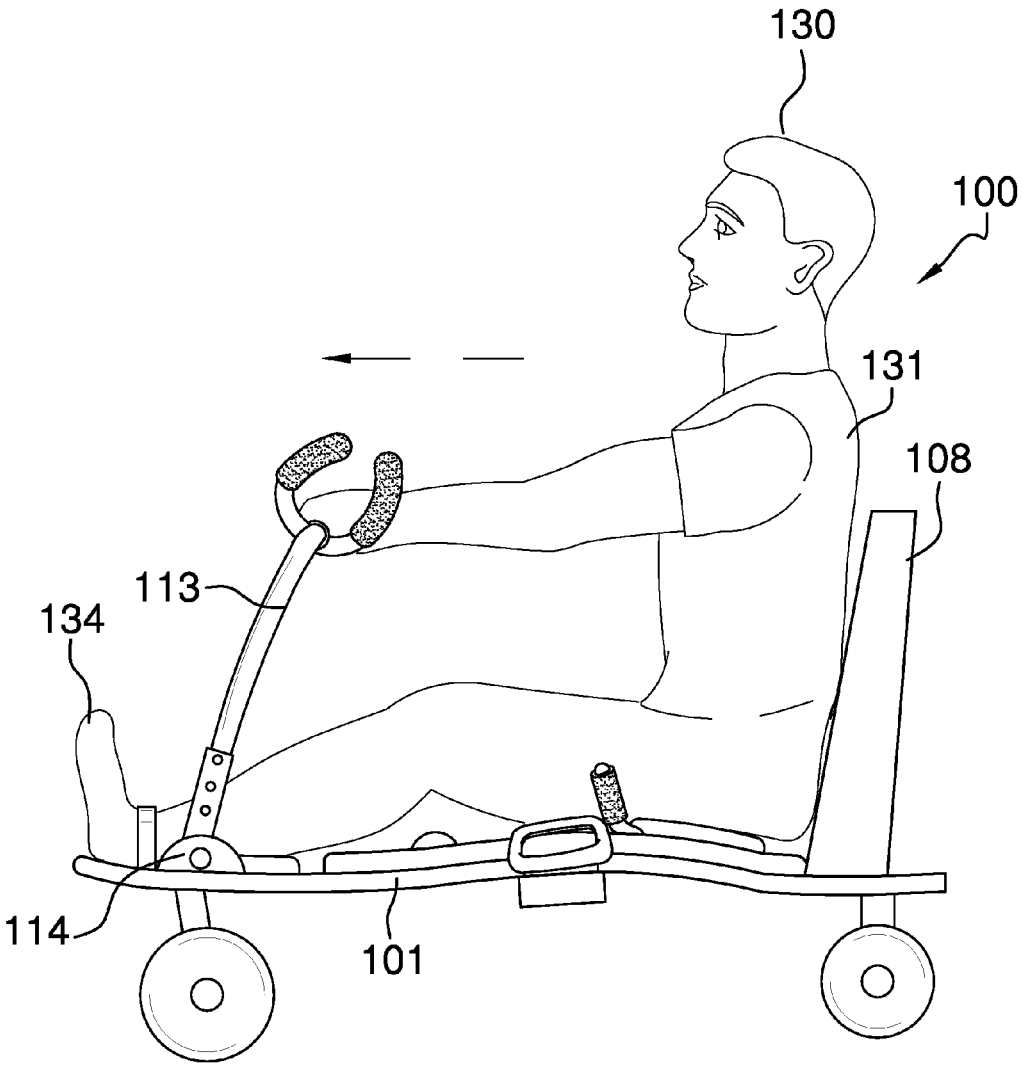
FIG. 7 illustrates a side view of the exercising skateboard in which the end user is seated upon the skateboard while resting the back against the backrest.

The skateboard deck 101 is further defined with a top surface 107, which enable a seatback 108 to attach adjacent the tail end 101A. The seatback 108 is included to enable an end user 130 to lean his/her back 131 there against when using the invention 100 as depicted in FIG. 7. The seatback 108 is an inwardly curved surface 109 that curves to support the back 131 of the end user 130.

Figure 6:
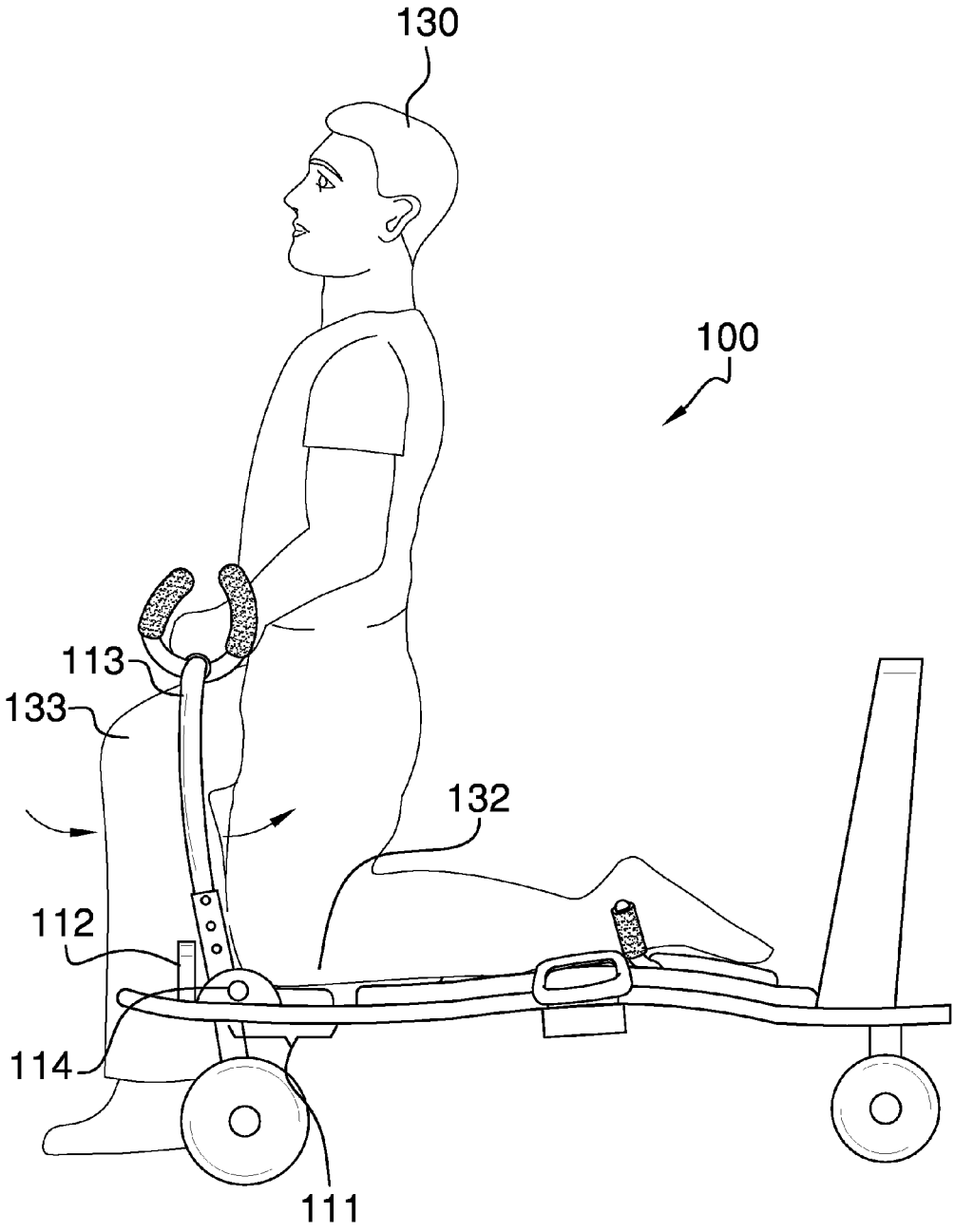
FIG. 6 illustrates a side view of the exercising skateboard in use wherein the end user is kneeling upon the skateboard with a first knee while an opposing leg is used to propel the skateboard and end user.

The skateboard deck 101 also includes knee pads 111 that are located elsewhere on the top surface 107, and which provides a contoured surface with which to rest a knee 132 of the end user 130 as depicted in FIG. 6, and which enables the end user 130 to kneel on the invention 100 while propelling him/herself and the invention 100 via an opposing leg 133. The kneepads 111 are embedded into the top surface 107 and are positioned adjacent to foot straps 112. The use of the invention 100 in connection with the knee pads 111 is one of a plurality of exercises that can be performed in association with the invention 100.

Figure 8:
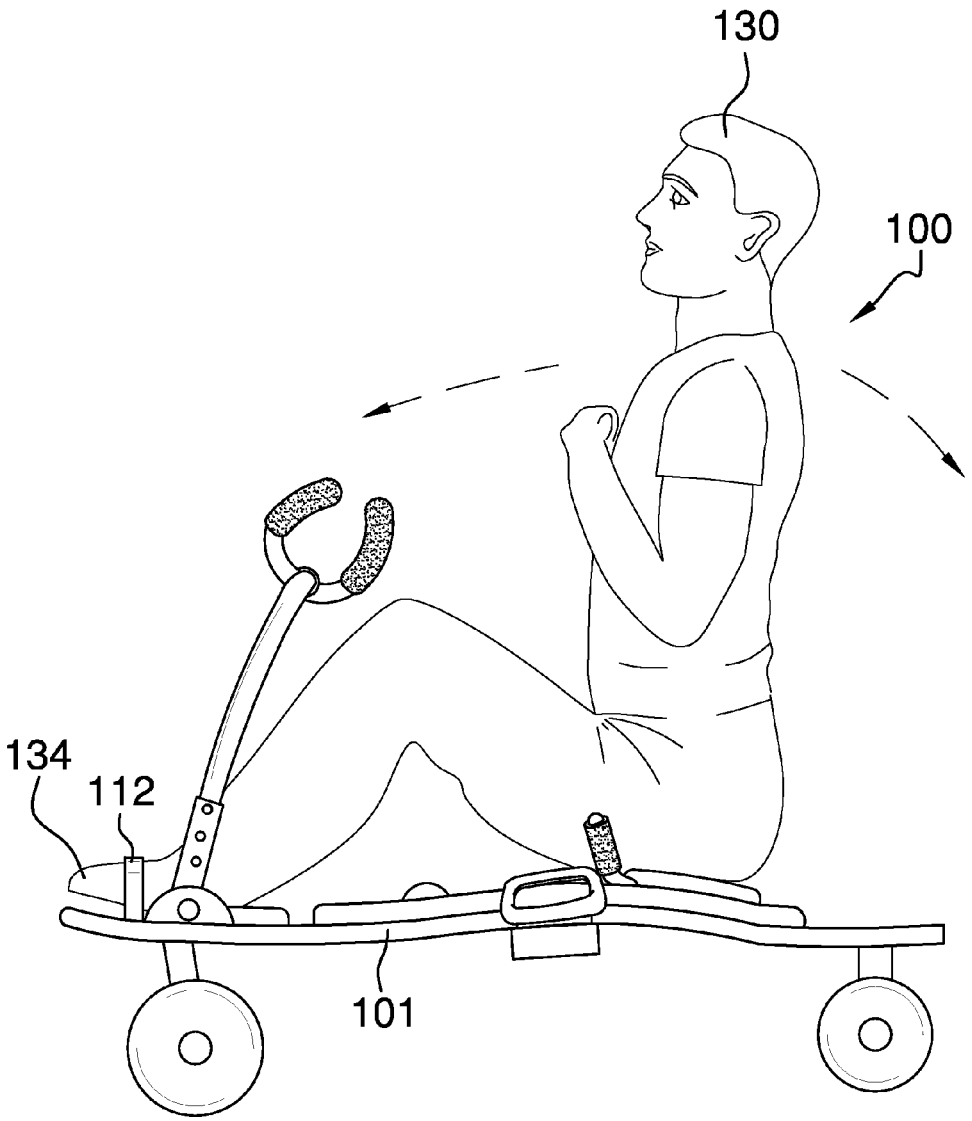
FIG. 8 illustrates a side view of the exercising skateboard in which the end user is seated upon the skateboard while conducting a sit up thereon.

The foot straps 112 are used in supporting feet 134 of the end user 130 to the top surface 107 of the skateboard deck 101. The foot straps 112 enable the end user 130 to conduct sit-up styled exercises, and is depicted in FIG. 8. It shall be noted that the end user 130 is seated on the top surface 107 of the skateboard deck 101 of the invention 100, and has his/her feet 134 secured to the foot straps 112, and performing sit-ups.

Figure 2:
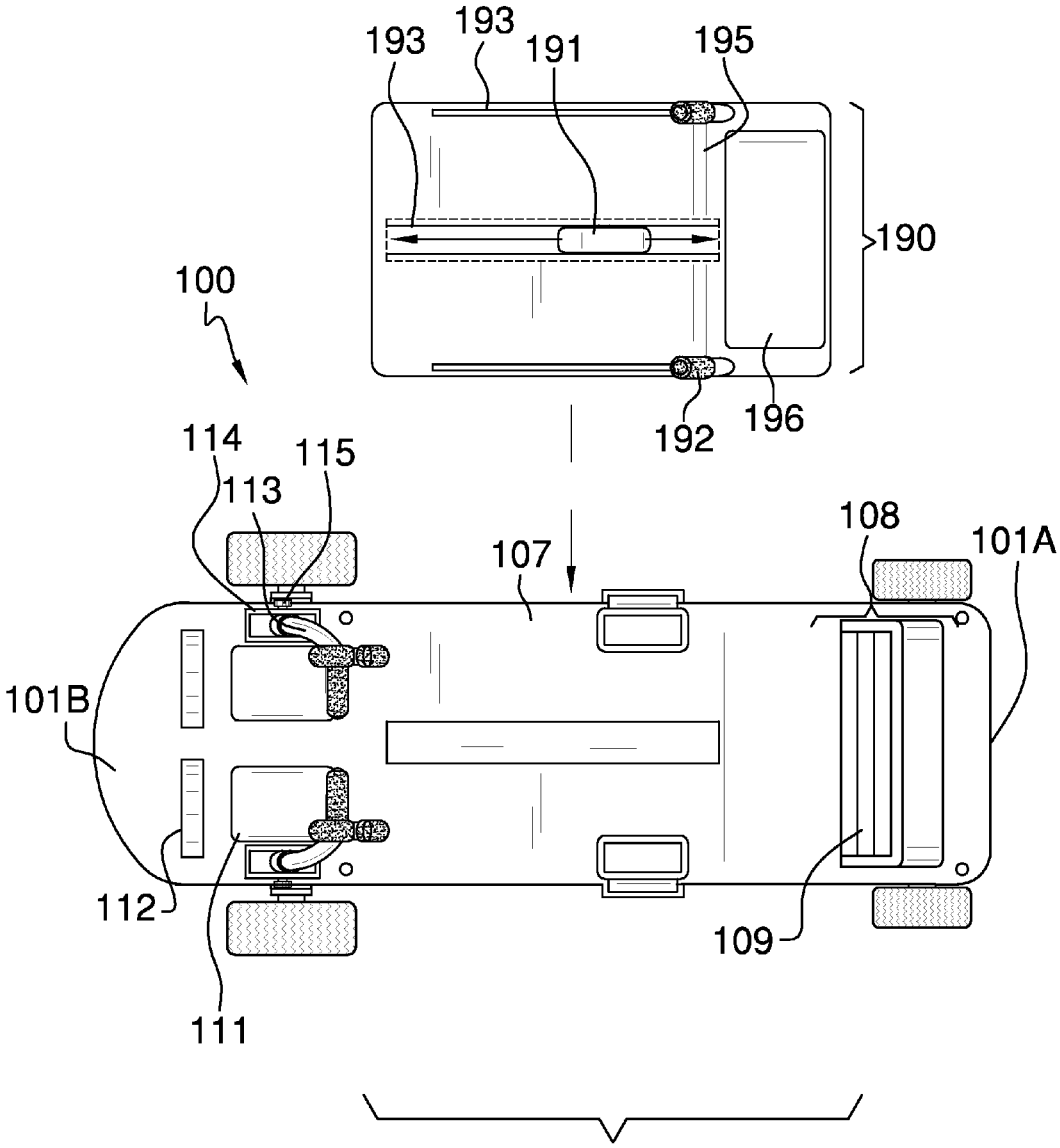
FIG. 2 illustrates a top view of the exercising skateboard.
Figure 3:
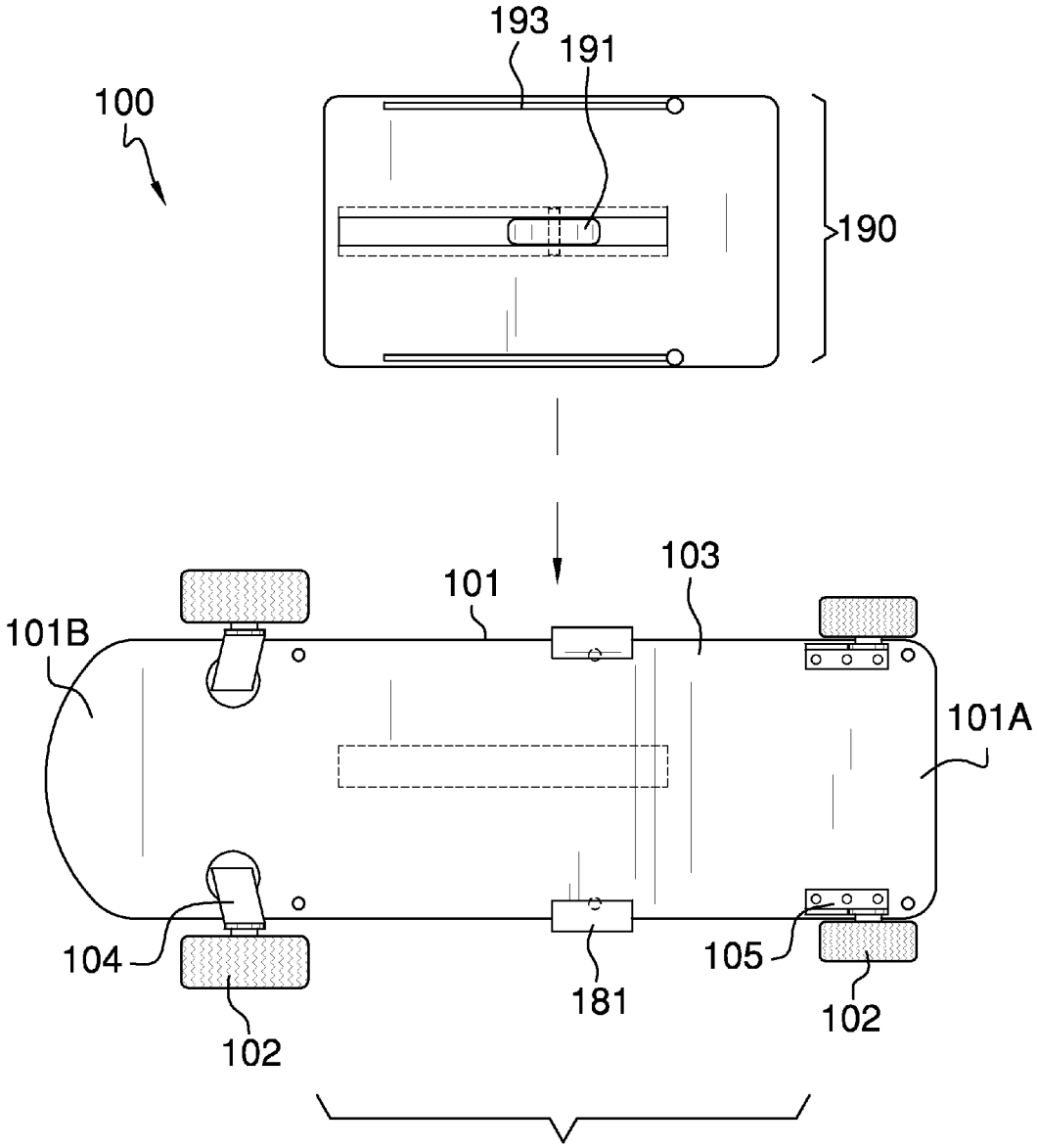
FIG. 3 illustrates a bottom view of the exercising skateboard.
Figure 4:
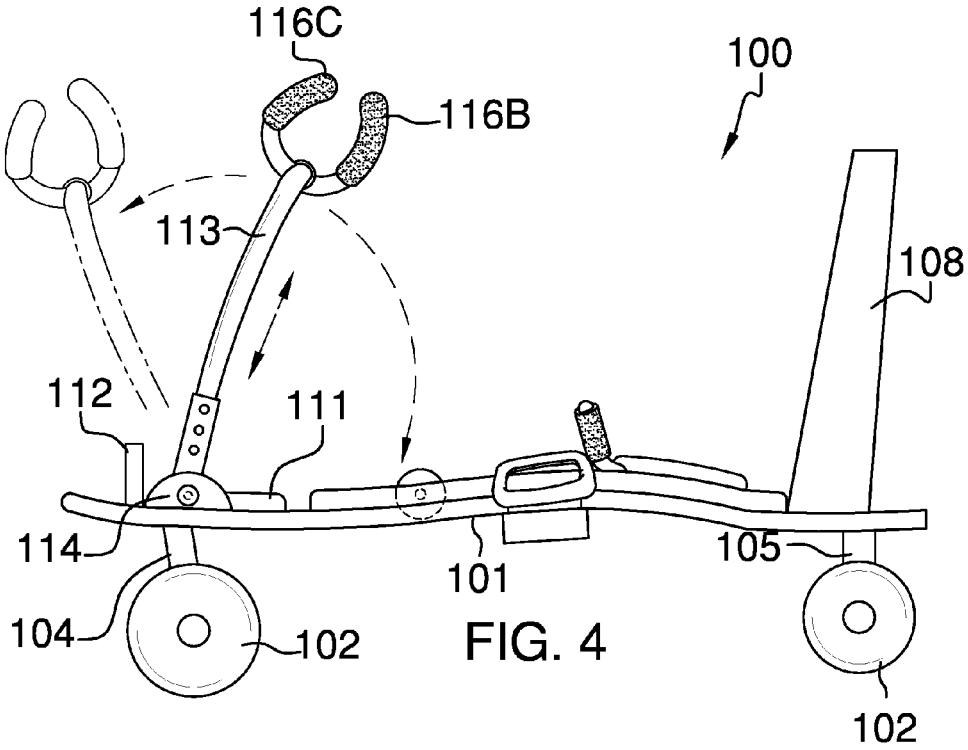
FIG. 4 illustrates a side view of the exercising skateboard.
Figure 5:
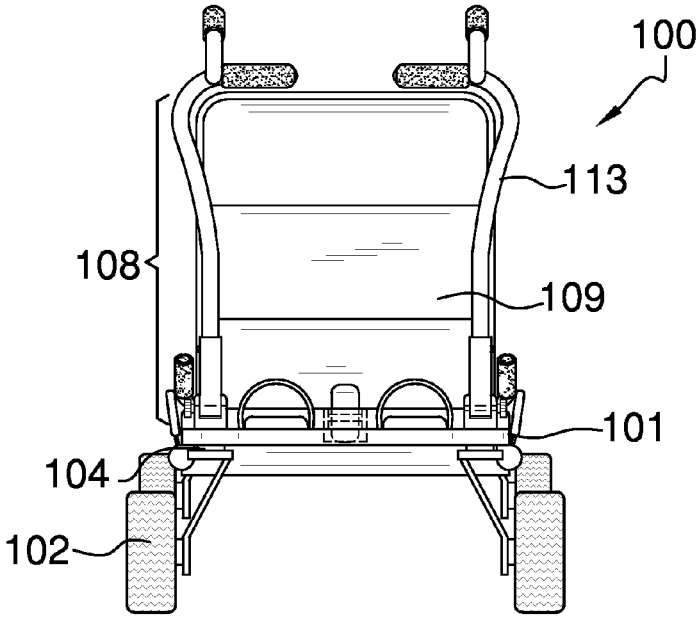
FIG. 5 illustrates a front view of the exercising skateboard.

Referring to FIG. 2, it shall be noted that the foot straps 112 and adjacent knee pads 111 are aligned together such that the feet 134 of the end user 130 shall be relatively close to one another when using the invention 100 in connection with the performance of sit-ups. Moreover, the foot straps 112 and the knee pads 111 are located between the seat back 108 and a pair of handles 113. Moreover, the foot straps 112 and the knee-pads 111 are located near the nose end 101B.

The pair of handles 113 attach to the top surface 107 of the skateboard deck 101, and are rotatably engaged with respect to a pivot point 114. The pivot point 114 enables the handles 113 to rotate forward and rearwardly with respect to the invention 100. The pivot points 114 include tensioning knobs 115, which enable adjustment of a tensioning force applied in rotating the handles 113 with respect to the invention 100. Moreover, the tensioning knobs 115 shall enable the handles 113 to lock at a particular orientation with respect to the invention 100.

The handles 113 are each comprised of a horizontal handle member 116A, a rear curved handle member 116B, and a forward curved handle member 116C. The rear curved handle member 116B is directed towards the rear of the invention 100 whereas the forward curved handle member 116C is directed towards the front of the invention 100. The rear curved handle member 116 is ideally grasped by the end user 130 seated or standing on the skateboard deck 101 whereas the forward curved handle member 116C may be grasped from aside of the skateboard deck 101. The horizontal handle 116A extends inwardly with respect to the rear curved handle member 116B and the forward curved handle member 116C.

As previously mentioned, the invention 100 may be used to perform a plurality of different exercises. Referring to FIG. 6, the end user 130 kneels onto the skateboard deck 101 via one knee 132 resting on one of the knee pads 111 located on the skateboard deck 101. The end user 101 may or may not grab hold of the handles 113 in order to help balance his/herself upon the invention 100 while riding and propelling his/herself via use of the opposing leg 133.

Referring to FIG. 7, the invention 100 may be used with the end user 130 riding on the invention 100, and in which case the end user 130 seats his/herself onto the top surface 107 of the skateboard deck 101 with his/her back 131 resting against the backseat 108. In such a situation, the end user 130 may elect to grab hold of the handles 113, and place the feet 134 beyond the pivot point 114 of the handles 113.

Referring to FIG. 8, the end user 130 may elect to use the invention 100 when conducting sit-ups, and which requires the back seat 108 to be entirely removed from the skateboard deck 101.

The invention 100 includes a set of lateral handles 180 that attach to and extend from spring-loaded webbing spindles 181. The spring-loaded webbing spindles 181 are mounted on opposing sides of the skateboard deck 101. The spring-loaded webbing spindles 181 enable the end user 130 to grab the lateral handles 180 and perform exercise working the arms of the end user 130 while standing or seated.

The invention 100 includes an ab wheel deck 190. The ab wheel deck 190 is a planar object that includes an ab wheel 191 as well as ab handles 192. The ab wheel deck 190 is selectively installed on the top surface 107 of the skateboard deck 101. The ab wheel 191 and the ab handles 192 are able to slide back and forth along ab grooves 193 integrated into the design of the ab wheel deck 190. The ab wheel 191 is connected with the ab handles 192 via lateral ab members 195 integrated therein. The ab wheel deck 190 also includes a seat cushion 196 that enables the end user 130 to sit thereon when in use with the invention 100 and/or ab wheel deck 190.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An exercising skateboard comprising:

a skateboard deck from which a plurality of wheels attach to a bottom surface, and enable the exercising skateboard to roll thereon;

a backseat that is selectively attached to the skateboard deck;

wherein a pair of knee pads and foot straps adorn the skateboard deck;

a pair of handles rotatably engaged with respect to the skateboard deck;

wherein the exercising skateboard may be used in a plurality of manners comprising kneeling, sitting, or standing;

wherein the wheels are either rotatable or non-rotatable;

wherein the skateboard deck is further defined with a top surface and a bottom surface; wherein the wheels attach to the bottom surface; wherein the skateboard deck has a flat tail end and a nose end distally opposite of the tail end;

wherein the skateboard deck the seatback is selectively attached to the top surface; wherein the seatback is selectively attached adjacent the tail end;

wherein the seatback is an inwardly curved surface that curves and is configured to support a back of the end user;

wherein the skateboard deck also includes knee pads that are located elsewhere on the top surface, and which provides a contoured surface configured to rest a knee of the end user; wherein the kneepads are embedded into the top surface and are positioned adjacent to foot straps.

2. The exercising skateboard as described in claim 1 wherein the foot straps are configured to support feet of the end user to the top surface of the skateboard deck.

3. The exercising skateboard as described in claim 2 wherein the foot straps and adjacent knee pads are aligned together such that the feet of the end user shall be relatively close to one another; wherein the foot straps and the knee pads are located between the seat back and a pair of handles; wherein the foot straps and the knee-pads are located near the nose end of the skateboard deck.

4. The exercising skateboard as described in claim 3 wherein the pair of handles attach to the top surface of the skateboard deck, and are rotatably engaged with respect to a pivot point; wherein the pivot point enables the handles to rotate forward and rearwardly with respect to the skateboard deck; wherein the pivot points include tensioning knobs, which enable adjustment of a tensioning force applied in rotating the handles with respect to the skateboard deck; wherein the tensioning knobs enable the handles to lock at a particular orientation with respect to the skateboard deck.

5. The exercising skateboard as described in claim 4 wherein the handles are each comprised of a horizontal handle member, a rear curved handle member, and a forward curved handle member; wherein the rear curved handle member is directed towards the rear of the skateboard deck whereas the forward curved handle member is directed towards the front of the skateboard deck; wherein the horizontal handle extends inwardly with respect to the rear curved handle member and the forward curved handle member.

6. The exercising skateboard as described in claim 5 wherein a set of lateral handles that attach to and extend from spring-loaded webbing spindles; wherein the spring-loaded webbing spindles are mounted on opposing sides of the skateboard deck; wherein the spring-loaded webbing spindles are configured for the end user to grab the lateral handles and perform exercise working the arms of the end user.

7. The exercising skateboard as described in claim 5 wherein an ab wheel deck includes an ab wheel as well as ab handles; wherein the ab wheel deck is selectively installed on the top surface of the skateboard deck; wherein the ab wheel and the ab handles slide back and forth along ab grooves integrated into the design of the ab wheel deck, and which are configured to target the abdominal muscles of the end user.

8. The exercising skateboard as described in claim 7 wherein the ab wheel is connected with the ab handles via lateral ab members integrated therein; wherein the ab wheel deck includes a seat cushion that enables the end user to sit thereon.

9. An exercising skateboard comprising:

a skateboard deck from which a plurality of wheels attach to a bottom surface, and enable the exercising skateboard to roll thereon;

a backseat that is selectively attached to the skateboard deck;

wherein a pair of knee pads and foot straps adorn the skateboard deck;

a pair of handles rotatably engaged with respect to the skateboard deck;

wherein the exercising skateboard may be used in a plurality of manners comprising kneeling, sitting, or standing;

wherein the wheels are either rotatable or non-rotatable;

wherein the skateboard deck is further defined with a top surface and a bottom surface; wherein the wheels attach to the bottom surface; wherein the skateboard deck has a flat tail end and a nose end distally opposite of the tail end;

wherein the skateboard deck the seatback is selectively attached to the top surface; wherein the seatback is selectively attached adjacent the tail end;

wherein the seatback is an inwardly curved surface that curves and is configured to support a back of the end user;

wherein the skateboard deck also includes knee pads that are located elsewhere on the top surface, and which provides a contoured surface configured to rest a knee of the end user; wherein the kneepads are embedded into the top surface and are positioned adjacent to foot straps; wherein the foot straps are configured to support feet of the end user to the top surface of the skateboard deck.

10. The exercising skateboard as described in claim 9 wherein the foot straps and adjacent knee pads are aligned together such that the feet of the end user shall be relatively close to one another; wherein the foot straps and the knee pads are located between the seat back and a pair of handles; wherein the foot straps and the knee-pads are located near the nose end of the skateboard deck.

11. The exercising skateboard as described in claim 10 wherein the pair of handles attach to the top surface of the skateboard deck, and are rotatably engaged with respect to a pivot point; wherein the pivot point enables the handles to rotate forward and rearwardly with respect to the skateboard deck; wherein the pivot points include tensioning knobs, which enable adjustment of a tensioning force applied in rotating the handles with respect to the skateboard deck; wherein the tensioning knobs enable the handles to lock at a particular orientation with respect to the skateboard deck; wherein the handles are each comprised of a horizontal handle member, a rear curved handle member, and a forward curved handle member; wherein the rear curved handle member is directed towards the rear of the skateboard deck whereas the forward curved handle member is directed towards the front of the skateboard deck; wherein the horizontal handle extends inwardly with respect to the rear curved handle member and the forward curved handle member.

12. The exercising skateboard as described in claim 11 wherein a set of lateral handles that attach to and extend from spring-loaded webbing spindles; wherein the spring-loaded webbing spindles are mounted on opposing sides of the skateboard deck; wherein the spring-loaded webbing spindles are configured for the end user to grab the lateral handles and perform exercise working the arms of the end user.

13. The exercising skateboard as described in claim 12 wherein an ab wheel deck includes an ab wheel as well as ab handles; wherein the ab wheel deck is selectively installed on the top surface of the skateboard deck; wherein the ab wheel and the ab handles slide back and forth along ab grooves integrated into the design of the ab wheel deck, and which are configured to target the abdominal muscles of the end user; wherein the ab wheel is connected with the ab handles via lateral ab members integrated therein; wherein the ab wheel deck includes a seat cushion that enables the end user to sit thereon.

* * * * *